US005284389A

United States Patent [19]

Lumsden

[11] Patent Number: 5,284,389

[45] Date of Patent: Feb. 8, 1994

[54] JUICE CONCENTRATE MIXING AND DISPENSING APPARATUS

[76] Inventor: Karen J. Lumsden, 3415 - 25th Ave., Marion, Iowa 52302

[21] Appl. No.: 69,530

[22] Filed: Jun. 1, 1993

[51] Int. Cl.[5] ..... B01F 11/00

[52] U.S. Cl. ..... 366/256; 366/332

[58] Field of Search ..... 366/255, 256, 257, 258, 366/259, 260, 332, 333, 334, 335

[56] References Cited

U.S. PATENT DOCUMENTS

| | | | |
|---|---|---|---|
| 1,174,828 | 3/1916 | Copeland | 366/256 |
| 2,726,071 | 12/1955 | Bernhardt | 366/256 |
| 3,154,123 | 10/1964 | Tomlinson . | |
| 4,010,934 | 3/1977 | McCord et al. . | |
| 4,169,681 | 10/1979 | Kato . | |
| 4,359,283 | 11/1982 | McClellan . | |
| 4,460,279 | 7/1984 | Krasney . | |
| 4,893,940 | 1/1990 | Waisberg . | |

*Primary Examiner*—Robert W. Jenkins
*Attorney, Agent, or Firm*—Simmons, Perrine, Albright & Ellwood

[57] ABSTRACT

An improved mixing and dispensing apparatus for reconstituting and remixing reconstituted juice concentrate includes a container, a spout, a cap with a skirt and a mixing element with a shaft having a handle at one end and a mixing head at the other end. The mixing head is adapted to displace the liquid substantially radially and non-circularly and only moderately axially relative to the shaft as the shaft is reciprocally displaced axially relative to the cap. The container has indicia for indicating the quantity of liquid contained therein. The container generally has a non-circularly shaped cavity which, in cooperation with the mixing head, prevents rotational displacement of the mixing head relative to the cavity. Alternatively, a shaft opening in the cap and a cross-sectional profile of the shaft cooperatively prevent relative rotational therebetween. The skirt has pour openings which may be selectively and separately spaced adjacently to the spout such that ice contained in the liquid may be poured from, or restricted to, the container or non-adjacently to the spout such that ambient atmospheric oxidation is minimal. An upstop limits initial displacement of the mixing head to total emersion in the liquid. The upstop is adjustable for varying initial quantities of the liquid.

8 Claims, 1 Drawing Sheet

JUICE CONCENTRATE MIXING AND DISPENSING APPARATUS

BACKGROUND OF THE INVENTION

For those with discerning taste, it is well known that juice concentrate reconstituted by stirring with a spoon tastes substantially better than that reconstituted by using a blender or by shaking a container containing the juice. The loss in taste probably results from the blending of substantial quantities of air into the juice because of the turbulent and swirling action of the blender or shaker. To the contrary, the improved taste when using a spoon probably results from the avoidance of significant inclusion of ambient atmospheric air into the mixture because of substantially reduce turbulence. However, stirring with a spoon generally requires a circular displacement of the mixture and breaking the free surface of the mixture with a handle of the spoon, which also introduces some atmospheric air into the mixture. In addition, the latter not only produces a drippy spoon when the juice concentrate is reconstituted, but also produces another drippy spoon each time the juice is re-stirred prior to dispensing thereof.

Thus, what is needed is an apparatus which provides a mixer for reconstituting the juice concentrate while substantially minimizing inclusion of ambient atmospheric air in the juice without the use of another appliance or utensil such as a spoon and which, in addition, provides a container for subsequently remixing the reconstituted juice concentrate as needed again without the use of another utensil.

SUMMARY OF THE INVENTION

An improved apparatus is provided for mixing and dispensing reconstituted juice concentrate. The apparatus generally comprises containing means, closing means, and mixing means. The containing means generally includes a container having a cavity with a relatively uniform cross-section along a longitudinal axis thereof. The shape of the cross-section is preferably non-circular, such as square or any other desired configuration. The cavity is configured with sufficient capacity to contain the juice concentrate together with the dilutant, such as water, needed to reconstitute the concentrate to desired strength. Generally, the container is constructed of molded, translucent plastic whereby a user can compare the quantity of juice contained in the container with indicia molded in or printed on a wall of the container.

The closing means generally includes a cap adapted to sealingly engage an upper end of the container. The lid generally has a skirt adapted to be slidably inserted into the cavity adjacent to the upper end of the container. Alternatively, the cap may be adapted to resiliently snap over a lip spaced near or at the upper end of the container to form the sealing engagement.

The mixing means generally includes a shaft connected to a mixing head. The shaft is adapted to be slidably and reciprocally displaced axially through a shaft opening spaced generally centrally in the cap. Similarly, the mixing head is adapted to be slidably and reciprocally displaced axially in the cavity. The mixing head has cutouts which are adapted to displace the liquid contained in the container substantially radially, inwardly and outwardly and substantially non-circularly as the shaft and the mixing head are reciprocally displaced relative to the container and cap connected thereto. The thickness of the mixing head is adapted such that the liquid is only moderately displaced axially as the mixing head as displaced axially.

The mixing means generally includes a handle which can be grasped by either hand of a user. If desired, the mixing means may also include an upstop adapted to limit upward displacement of the mixing head such that initial displacement thereof is confined to submersion of the mixing head within the liquid contained in the container. The upstop can be releasably affixed to a selected one of a plurality of annular grooves, corresponding to the quantity of liquid contained in the container.

Alternatively, if it is desired that the cavity have a circularly shaped cross-section, then the shaft is configured with a non-circular cross-section and the shaft opening is cooperatively configured such that the shaft cannot be rotationally displaced relative to the cap.

OBJECTS AND ADVANTAGES OF THE INVENTION

Therefore, the principal objects and advantages of the present invention are: to provide a device for reconstituting juice concentrates; to provide such a device for remixing and dispensing juice concentrates; to provide such a device which substantially minimizes or eliminates swirling of juice concentrate as it is being reconstituted or mixed therein; to provide such a device which mixes the liquid contained therein by displacing the liquid substantially radially inwardly and outwardly and only moderately axially; to provide such a device that minimizes ambient atmospheric oxidization of the liquid contained therein; to provide such a device that selectively allows ice to be either poured therefrom with the liquid being displaced or restricted to the confines of the device as the liquid is being dispensed; to provide such a device which initially limits a mixing head thereof to displacement within the liquid contained therein without breaking the free surface of the liquid; to provide such a device with upstops which permit varying the limited displacement of a mixing head to adjust for different quantities of liquid to be mixed therein; and to generally provide a device which is relatively easy to use, simple to maintain, easy to operate efficiently and reliably, and which generally performs the requirements of its intended purposes.

Other objects and advantages of this invention will become apparent from the following description taken in conjunction wit the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
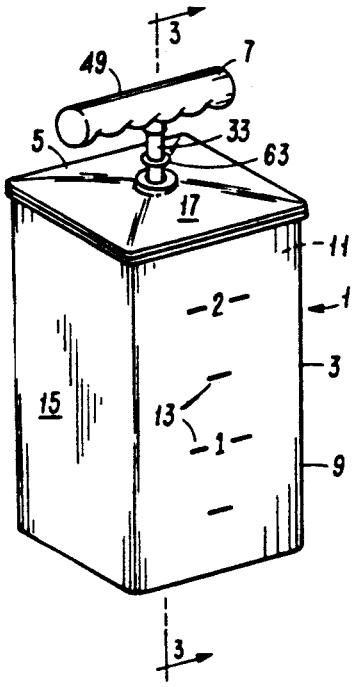
FIG. 1 is a perspective view of a juice concentrate mixing and dispensing apparatus, according to the present invention.
Figure 2:
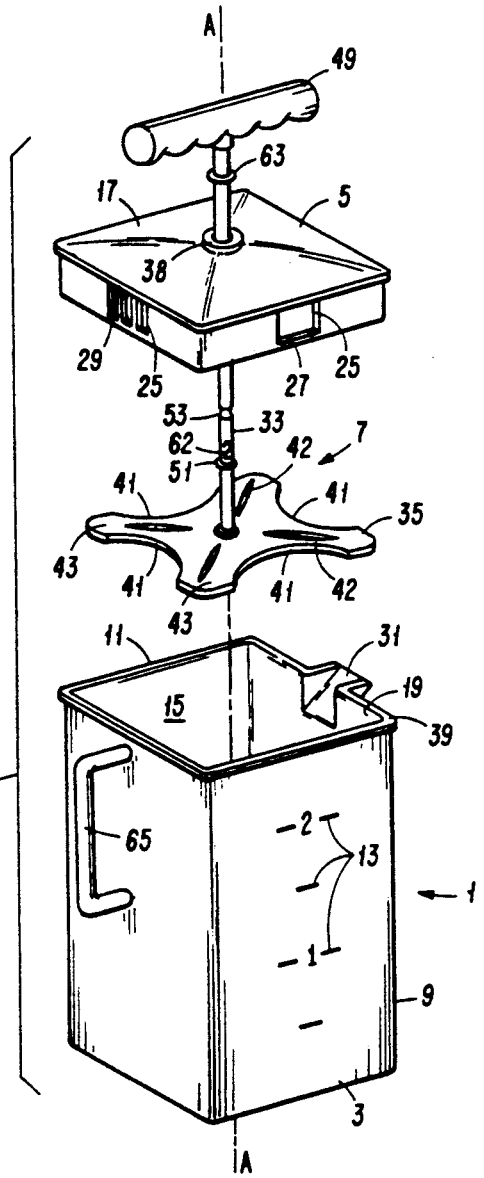
FIG. 2 is a perspective, exploded view of the juice concentrate mixing and dispensing apparatus.

A juice concentrate mixing and dispensing apparatus 1 generally comprises containing means 3, closure means 5, and a mixing element or mixing means 7. The containing means 3 includes a container 9 with a cavity 11 having a relatively uniform cross-section along an axis A—A thereof 11*a*. Preferably, the container 9 is constructed with a square-shaped cross-sectional profile, as shown in FIGS. 1 and 2, with appropriate outer dimensions, with or without rounded corners, such that the apparatus 1 can be conveniently stored in the door-shelf of a refrigerator (not shown).

Similarly, the cross-sectional profile of the cavity 11 is preferably square-shaped, or any other non circular configuration. Alternatively, the cross-sectional profile of the cavity 11 may be circular as hereinafter described.

The cavity 11 is generally adapted to have sufficient capacity to contain juice concentrate (not shown) together with the water or other liquid needed to reconstitute the concentrate to desired strength, such as a capacity of 1 quart, 2 quarts, or the like. Generally, the container 9 is constructed of molded, translucent plastic whereby a user can compare the quantity of fluid 12 contained in the container 9 with container indicia 13 molded into or printed on a wall 15 of the container 9, as shown in FIGS. 1 and 2.

The closure means 5 generally includes a lid or cap 17 adapted to sealingly engage an upper end 19 of the container 9. The cap 17 generally has a skirt 21 adapted to be slidably inserted into the cavity 6 adjacently to the upper end 19. Alternatively, the cap 17 may be adapted to resiliently snap over a lip 23, spaced near or at the upper end 19 to form such sealing engagement, as shown in FIG. 3*a*.

The cap 17 is adapted such that the sealing engagement hereinbefore described minimizes exposure of liquid 12 contained in the container 9 to the ambient atmosphere thereabout, which would otherwise tend to oxidize certain components of the reconstituted juice 12, thereby giving it a bland taste. The skirt 21 generally comprises one or more pour openings 25. Preferably, one of the openings 25, such as the pour opening 25, indicated by the numeral 27 in FIG. 2, permits ice (not shown) contained in the container 9 to be dispensed along with the liquid 12 contained in the container 9. Also, one of the pour openings 25, such as the pour opening 25 indicated by the numeral 29 in FIG. 2, restricts (unshown) ice contained in the container 9 from being dispensed with the liquid 12.

Figure 3:
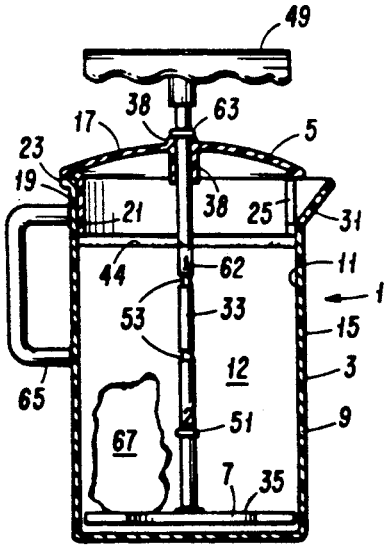
FIG. 3 is a cross-sectional view of the juice concentrate mixing and dispensing apparatus, taken generally along line 3—3 of FIG. 1.
Figure 3A:
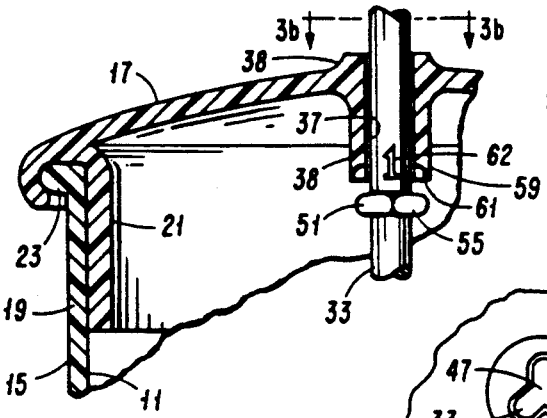
FIG. 3*a* is an enlarged, cross-sectional and fragmentary view of the juice concentrate mixing and dispensing apparatus, showing a cap resiliently connected to a lip of an upper wall thereof.

The pour openings 25 are adapted to be selectively spaced adjacently to a spout 31 formed in the upper end 19 of the container wall 15, such as is indicated in FIG. 3. After dispensing liquid 12 from the container 9, the cap 17 can be readjusted such that none of the pour openings 25 are spaced adjacently to the spout 31, and the spout 31 is isolated by the skirt 21 such that exposure of the liquid 12 remaining in the container 9 to ambient atmospheric oxidation is again minimized.

The spout 31 may be spaced along one side of the container 9, as shown in FIG. 2, or, alternatively, may be spaced at or near a corner 39 of the container 9.

The mixing means 7 generally includes a shaft 33 connected to a mixing head 35, extending generally radially outwardly from the shaft 33 The shaft 33 is adapted to be slidably and reciprocally displaced axially through a shaft opening 37 in the cap 17. Generally, the shaft opening 37 is centrally disposed in the cap 17. A sleeve 38 surrounds the shaft opening 37 to provide reinforcement thereof.

Similarly, the mixing head 35 is adapted to be slidably and reciprocally displaced axially along the cavity 11. The mixing head 35 generally has profiled cutouts 41, which are adapted to displace the liquid 12 contained in the container 9 alternately above and below the mixing head 35, substantially radially, as the shaft 33 and the mixing head 35 are reciprocally displaced relative to the container 5. If desired, the mixing head 35 may also have one or more slots 42 to assist the cutouts 41 with displacement of the liquid 12 as described herein. Generally, the mixing head 35 has fingers 43 which are adapted to cooperate with the container wall 15 and thereby prevent rotational displacement of the mixing head 35 relative to the container 9.

The cutouts are also designed such that substantially equal parts of the liquid are potentially displaced clockwise and counterclockwise such that the net displacement thereof is substantially non-circular about the shaft 33 as the mixing head 35 is reciprocally displaced relative to the container 5. In addition, the axial thickness of the mixing head 35 is adapted to only moderately displace the liquid 12 axially as the mixing head 35 is reciprocally displaced relative to the container 5 to thereby minimize creation of turbulence of the liquid 12 at a free surface 44 thereof.

Figure 3B:
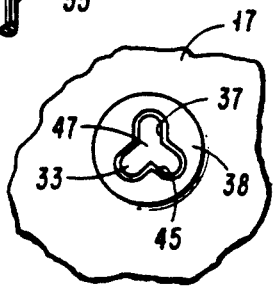
FIG. 3*b* is a further enlarged, cross-sectional and fragmentary plan view of the juice concentrate mixing and dispensing apparatus, taken generally along line 3*b*—3*b* of FIG. 3*a*, showing a shaft and a shaft opening having non-circular configurations, according to the present invention.

If it is desired that the cavity 11 have a circular cross-section, the shaft opening 37 is generally non-circularly shaped, such as that indicated by numeral 45 in FIG. 3*b*. The cross-sectional profile of the shaft 33 is then configured, such as that indicated by numeral 47 in FIG. 3*b*, to cooperate with the shaft opening 45 such that the mixing head 35 cannot be displaced rotationally relative to the cap 17.

It is foreseen that the mixing head 35 may be oval shaped or may have any other desired, preferably non-circular, configuration by adapting, if necessary, the cross-sectional profile 45 of the shaft 33 to cooperatively prevent relative rotational displacement between the shaft 33 and the cap 17 as herein described.

The mixing means 7 generally includes a mixing handle 49 which is adapted to be grasped by either hand of a user. The mixing means 7 generally includes an upstop 51, which is adapted to limit the upward displacements of the mixing head 35 in the cavity 11 such that the mixing head 35 remains confined to submersion within the liquid 12 contained in the cavity 11 and does not break the free surface 44 of the liquid 12.

If desired, a plurality of annular grooves 53 may be spaced along the shaft 33, as appropriate, to accommodate various quantities of the liquid 12 corresponding to the packaged quantities of juice concentrate commercially available. In that event, the upstop 51 is adapted to be easily removable, such as being constructed in the form of a split ring as indicated by numeral 55 in FIG. 3a, and is adapted to be easily releasably connected to the shaft 33 in a selected one of the grooves 53. A bottom end 59 of the sleeve 38 has a stop profile 61, which is adapted to receive and cooperate with the upstop 51 such that the upstop 51 is retained in the respective groove 53 in the event that the upstop 51 contacts the sleeve 38 as the juice 12 in the container 9 is being reconstituted or re-mixed. If desired, shaft indicia 62 are provided in or on the shaft 33 to correlate the respective grooves 53 with corresponding quantities of the liquid 12 contained in the cavity 11 such that initial displacements of the mixing head 35 will be confined in total emersion in the liquid 12 and thereby avoid disturbance of the free surface 44 of the liquid 12.

If desired, the apparatus 1 may include a down stop 63 which is adapted to limit downward displacements of the mixing head 35 in the cavity 11. A grip 65 may be provided for handling purposes.

In use, juice concentrate 67 is placed in the cavity 11 together with the water or other liquid being used to reconstitute the juice concentrate 67. The upstop 51 is snapped about one of the grooves 53 corresponding to the total quantity of liquid contained in the container 9, whereby the mixing head 35 is prevented from breaking the free surface 44 of the liquid 12 due to contact between the upstop 51 and the stop profile 61 of the bottom end 59 of the sleeve 38.

The mixing head 35 is then submerged in the liquid 12 contained in the container 9 and the cap 17 is placed in sealing engagement with the container 9, generally with all of the pour openings 25 spaced non-adjacently to the spout 31. If the juice concentrate 67 is frozen or chunky, the container 9 with the juice concentrate 67 and dilutant ma be allowed to stand until the juice concentrate 67 has completely thawed.

Then, the mixing handle 49 is gently moved alternately upwardly and downwardly, thereby displacing the shaft 33 and the mixing head 35 axially relative to the cavity 11. As the mixing head 35 is thus displaced, the juice concentrate 67 and dilutant are alternately displaced substantially radially outwardly, moderately vertically through the respective cutouts 41, and substantially radially inwardly.

Such procedure is repeated several times until the juice concentrate 67 and dilutant are thoroughly mixed. The upward and downward displacements of the mixing head 35 should be sufficiently gentle, thereby avoiding excessive turbulence of the free surface 44 of the liquid 12 such that blending of the air above the liquid 12 into the liquid 12 itself is minimized.

For dispensing reconstituted liquid 12 from the apparatus 1, the cap 17 is removed form the container 9, appropriately positioned, and re-connected to the container 9 such that a selected one of the pour openings 25, either the opening 27 or the opening 29, is spaced adjacently to the spout 31. After dispensing a desired amount of the liquid 12 from the container 9, the cap 27 is again removed from the container 9, appropriately re-positioned, and again re-connected to the container 9 such that none of the pour openings 25 are spaced adjacently to the spout 31.

If is foreseen that the apparatus 1 could be used for mixing and dispensing mixtures formed not only from concentrates, but also from powders, such as tea, flavored drinks, such as KoolAid ®, and the like.

It is to be understood that while certain forms of the present invention have been illustrated and described herein, it is not to be limited to the specific forms or arrangement of parts described and shown.

What is claimed and desired to be secured by letters patent is as follows:

1. A device for mixing and dispensing liquids, comprising:

(a) a container having a substantially rectangularly shaped horizontal cross-section, said container having a cavity for containing the liquid such that the liquid has a free upper surface; said cavity having an open upper end; said cavity having a generally uniform, non-circularly shaped, horizontal cross-section; said container constructed of translucent material; said container having indicia adapted to indicate the quantity of liquid contained in said cavity;

(b) a spout connected to said container;

(c) a cap adapted to close said upper end of said cavity; said cap having a centrally spaced shaft opening; said cap having a skirt spaced adjacently to said upper end of said cavity as said cap is connected to said container; said skirt having a first pour opening adapted to be selectively spaced adjacently to said spout such that ice contained in the liquid can be poured from the container; said skirt having a second pour opening adapted to be selectively spaced adjacently to said spout such that ice contained in the liquid is retained in the container as the liquid is poured therefrom; said first pour opening and said second pour opening adapted to be jointly and selectively spaced non-adjacently to said spout such that ambient atmospheric oxidation of the liquid is minimized;

(d) a mixing element having an elongate shaft with a proximal end and a distal end; said shaft adapted to be reciprocally and axially displaced relative to said shaft opening; said mixing element having a handle connected to said proximal end of said shaft; said mixing element having a mixing head connected to said distal end of said shaft such that said mixing head is submerged in the juice contained in the container as said cap is connected to said container; said mixing head extending generally transversely outwardly from said shaft; said mixing head having cutouts adapted to displace the liquid substantially radially inwardly, outwardly, and non-circularly relative to said shaft as said shaft is axially and reciprocally displaced; said mixing head adapted to displace the liquid only moderately axially relative to said shaft as said shaft is axially and reciprocally displaced;

(e) an upstop connected to said shaft such that, as said shaft is axially and reciprocally displaced, displacement of said mixing head is limited to total submersion in the liquid contained in said container; said upstop adapted to be selectively spaced along said shaft; and (f) a down stop connected to said shaft such that downward displacement of said mixing head within said cavity is limited.

2. An apparatus for mixing liquid contained therein, comprising:

(a) containing means having a cavity for containing the liquid such that the liquid has a free upper surface; said cavity having an upper end;

(b) closure means for connecting to said containing means such that said upper end of said cavity is substantially closed thereby; said closure means having a shaft opening spaced generally centrally to said closure means;

(c) mixing means for mixing the liquid contained in said cavity; said mixing means having an elongate shaft adapted for reciprocal and axial displacement of said mixing means relative to said shaft opening, said mixing means having a mixing head connected near a distal end of said shaft such that said mixing head is submerged in the liquid contained in said cavity as said closure means is connected to said containing means; said mixing head having structure adapted to displace the liquid substantially radially and non-circularly relative to said shaft and further having structure adapted to displace the liquid only moderately axially relative to said shaft as said shaft is reciprocally and axially displaced relative to said shaft opening; said shaft has at least one annular groove thereabout; and (d) confining means for confining the mixing head to displacement within the liquid contained in said cavity such that the mixing head does not substantially disturb the free surface of the liquid; said confining means includes an upstop adapted to be releasably connected to said shaft at a selected one of said at least one annular groove.

3. The apparatus according to claim 2, including:

(a) indicia on said shaft adapted to correlate said at least one annular groove with a corresponding quantity of the liquid contained in said cavity.

4. The apparatus according to claim 2, including:

(a) a stop profile spaced about said shaft opening; said stop profile adapted to receive said upstop as said upstop contacts said closure means.

5. An apparatus for mixing liquid contained therein, comprising:

(a) containing means having a cavity for containing the liquid such that the liquid has a free upper surface; said cavity having an upper end; said containing means having a spout adapted for pouring the liquid from the containing means;

(b) closure means for connecting to said containing means such that said upper end of said cavity is substantially closed thereby; said closure means having a shaft opening spaced generally centrally to said closure means; said closure means includes a skirt spaced adjacently to said upper end of said cavity as said closure means closed said upper end of said cavity; said closure means has at least two pour openings, which are adapted to be selectively spaced adjacently to said spout such that the liquid can be poured from the apparatus and spaced non-adjacently to said spout such that ambient atmospheric oxidation of the liquid is minimized; one of said at least two pour openings is adapted to permit ice contained in the liquid to be poured from said apparatus with the liquid and another one of said at least two pour openings is adapted to restrict ice contained in the liquid from being poured from the apparatus; and (c) mixing means for mixing the liquid contained in said cavity; said mixing means having an elongate shaft adapted for reciprocal and axial displacement of said mixing means relative to said shaft opening, said mixing means having a mixing head connected near a distal end of said shaft such that said mixing head is submerged in the liquid contained in said cavity as said closure means is connected to said containing means; said mixing head having structure adapted to displace the liquid substantially radially and non-circularly relative to said shaft and further having structure adapted to displace the liquid only moderately axially relative to said shaft as said shaft is reciprocally and axially displaced relative to said shaft opening.

6. An apparatus for mixing liquid contained therein, comprising:

(a) containing means having a cavity for containing the liquid such that the liquid has a free upper surface; said cavity having an upper end; said cavity has generally parallel opposing walls and has a non-circularly shaped horizontal cross-section;

(b) closure means for connecting to said containing means such that said upper end of said cavity is substantially closed thereby; said closure means having a shaft opening spaced generally centrally to said closure means; and (c) mixing means for mixing the liquid contained in said cavity; said mixing means having an elongate shaft adapted for reciprocal and axial displacement of said mixing means relative to said shaft opening, said mixing means having a mixing head connected near a distal end of said shaft such that said mixing head is submerged in the liquid contained in said cavity as said closure means is connected to said containing means; said mixing head having structure adapted to displace the liquid substantially radially and non-circularly relative to said shaft and further having structure adapted to displace the liquid only moderately axially relative to said shaft as said shaft is reciprocally and axially displaced relative to said shaft opening; said mixing head is adapted, in cooperation with said walls of said cavity, to provide substantially non-rotational displacement of said mixing head relative to said cavity.

7. An apparatus for mixing liquid contained therein, comprising:

(a) containing means having a cavity for containing the liquid such that the liquid has a free upper surface; said cavity having an upper end;

(b) closure means for connecting to said containing means such that said upper end of said cavity is substantially closed thereby; said closure means having a shaft opening spaced generally centrally to said closure means; said shaft opening is non-circularly shaped; and (c) mixing means for mixing the liquid contained in said cavity; said mixing means having an elongate shaft adapted for reciprocal and axial displacement of said mixing means relative to said shaft opening, said mixing means having a mixing head connected near a distal end of said shaft such that said mixing head is submerged in the liquid contained in said cavity as said closure means is connected to said containing means; said mixing head having structure adapted to displace the liquid substantially radially and non-circularly relative to said shaft and further having structure adapted to displace the liquid only moderately axially relative to said shaft as said shaft is reciprocally and axially displaced relative to said shaft opening; said shaft has a cross-sectional profile which is adapted, in conjunction with said shaft opening, to prevent rotational displacement of said mixing head relative to said closure means.

8. An apparatus for mixing liquid contained therein, comprising:

(a) containing means having a cavity for containing the liquid such that the liquid has a free upper surface; said cavity having an upper end; said containing means has a substantially rectangularly shaped horizontal cross-section;

(b) closure means for connecting to said containing means such that said upper end of said cavity is substantially closed thereby; said closure means having a shaft opening spaced generally centrally to said closure means; and (c) mixing means for mixing the liquid contained in said cavity; said mixing means having an elongate shaft adapted for reciprocal and axial displacement of said mixing means relative to said shaft opening, said mixing means having a mixing head connected near a distal end of said shaft such that said mixing head is submerged in the liquid contained in said cavity as said closure means is connected to said containing means; said mixing head having structure adapted to displace the liquid substantially radially and non-circularly relative to said shaft and further having structure adapted to displace the liquid only moderately axially relative to said shaft as said shaft is reciprocally and axially displaced relative to said shaft opening.

* * * * *